US007419399B2

(12) United States Patent
Yosler

(10) Patent No.: US 7,419,399 B2
(45) Date of Patent: Sep. 2, 2008

(54) PANEL MOUNT CONNECTOR WITH INTEGRATED LATCH AND POLARIZING KEY

(75) Inventor: James Christopher Yosler, Carlisle, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/012,317

(22) Filed: Dec. 15, 2004

(65) Prior Publication Data

US 2006/0128203 A1 Jun. 15, 2006

(51) Int. Cl.
*H01R 13/627* (2006.01)

(52) U.S. Cl. ..... 439/358; 439/680

(58) Field of Classification Search ..... 439/350–358, 439/542, 660, 677, 680
See application file for complete search history.

(56) References Cited

U.S. PATENT DOCUMENTS

| | | | | |
|---|---|---|---|---|
| 3,196,380 | A * | 7/1965 | Krehbiel | 439/557 |
| 3,417,365 | A * | 12/1968 | Krehbiel | 439/358 |
| 3,605,070 | A * | 9/1971 | Krafthefer | 439/357 |
| 5,246,380 | A * | 9/1993 | Kodama | 439/354 |
| 5,378,168 | A * | 1/1995 | Sumida | 439/358 |
| 5,487,678 | A * | 1/1996 | Tsuji et al. | 439/352 |
| 6,364,686 | B2 * | 4/2002 | Gimbel | 439/357 |
| 6,746,284 | B1 * | 6/2004 | Spink, Jr. | 439/740 |
| 2001/0016443 | A1 * | 8/2001 | Gimbel | 439/358 |
| 2004/0157498 | A1 * | 8/2004 | Hall et al. | 439/680 |
| 2006/0128203 | A1 * | 6/2006 | Yosler | 439/358 |

* cited by examiner

*Primary Examiner*—James Harvey

(57) ABSTRACT

A receptacle connector includes a nonconductive housing comprising a plug insertion opening extending therein, a latch projection extending outwardly from the opening, and an alignment slot proximate the plug insertion opening and partly defining the latch projection.

20 Claims, 4 Drawing Sheets

PANEL MOUNT CONNECTOR WITH INTEGRATED LATCH AND POLARIZING KEY

BACKGROUND OF THE INVENTION

This invention relates generally to electrical connectors, and, more specifically, to connectors having latches for engagement with mating connectors.

To prevent unintended separation of electrical connectors in use, some known electrical connectors include housings having deflectable latches which provide locking engagement to mating connector housings. Other electrical connectors include alignment features, such as keying surfaces, which guide a user in mating one connector to another and ensure that the mating connectors are properly engaged to one another. The alignment features allow mating of the connectors in only one orientation of the connectors relative to one another, and physically prevent mating of the connectors in other orientations. Such latching and alignment features are sometimes used in combination to achieve and maintain proper engagement of mating connectors in an electrical system.

While known latching and alignment features in known connectors have achieved some success in realizing and maintaining proper electrical engagement of connectors, in certain applications the latching and alignment features can become an impediment to effective use of the connector. For example, in panel mount connectors the latching and alignment features tend to undesirably increase the physical size of the connector. Because of the latching and alignment features, the connector thereby occupies a greater area, sometimes referred to as a footprint, on the panel. The latching and alignment features also tend to increase the bulk of the connector and can interfere with the installation of the connector to a panel. Still further, the latching and alignment features tend to result in uneven wall thickness in the housing of one or both of the mating connectors. The uneven wall thickness can compromise the structural strength of the connector, especially when the connectors are subject to large insertion forces when mated together.

BRIEF DESCRIPTION OF THE INVENTION

According to an exemplary embodiment, a receptacle connector comprises a nonconductive housing comprising a plug insertion opening extending therein, a latch projection extending outwardly from the opening, and an alignment slot proximate the plug insertion opening and partly defining the latch projection.

Optionally, the latch projection and the slot may be axially aligned with one another and the slot may be approximately centered with respect to the plug insertion opening. Panel mounting ears may be attached to the housing, and the latch projection and the latch feature may integrally formed into the housing.

According to another exemplary embodiment, a receptacle connector comprises a nonconductive housing comprising a plug insertion opening extending therein. An integrated latch and key element of uniform wall thickness is coupled to the housing, and the integrated latch and key element comprises a recessed slot extending adjacent the opening on an inner surface of the housing and a latch projection extending outwardly from an outer surface of the housing.

According to still another exemplary embodiment, a connector assembly comprises a receptacle connector comprising a housing having a plug insertion opening and a combined latch and keying element extending from the housing proximate the plug insertion opening. A portion of the latch and keying element extends interior to the plug insertion opening and a portion of the latch and keying element extends exterior to the plug insertion opening. A plug connector comprises a housing having a polarizing key and a locking latch element, the polarizing key being inserted into the plug insertion opening and received within the keying element when the plug connector is mated to the receptacle connector. The plug locking latch element is engaged to the latch element at a location exterior to the plug insertion opening when the plug connector is mated to the receptacle connector.

DETAILED DESCRIPTION OF THE INVENTION

Figure 1:
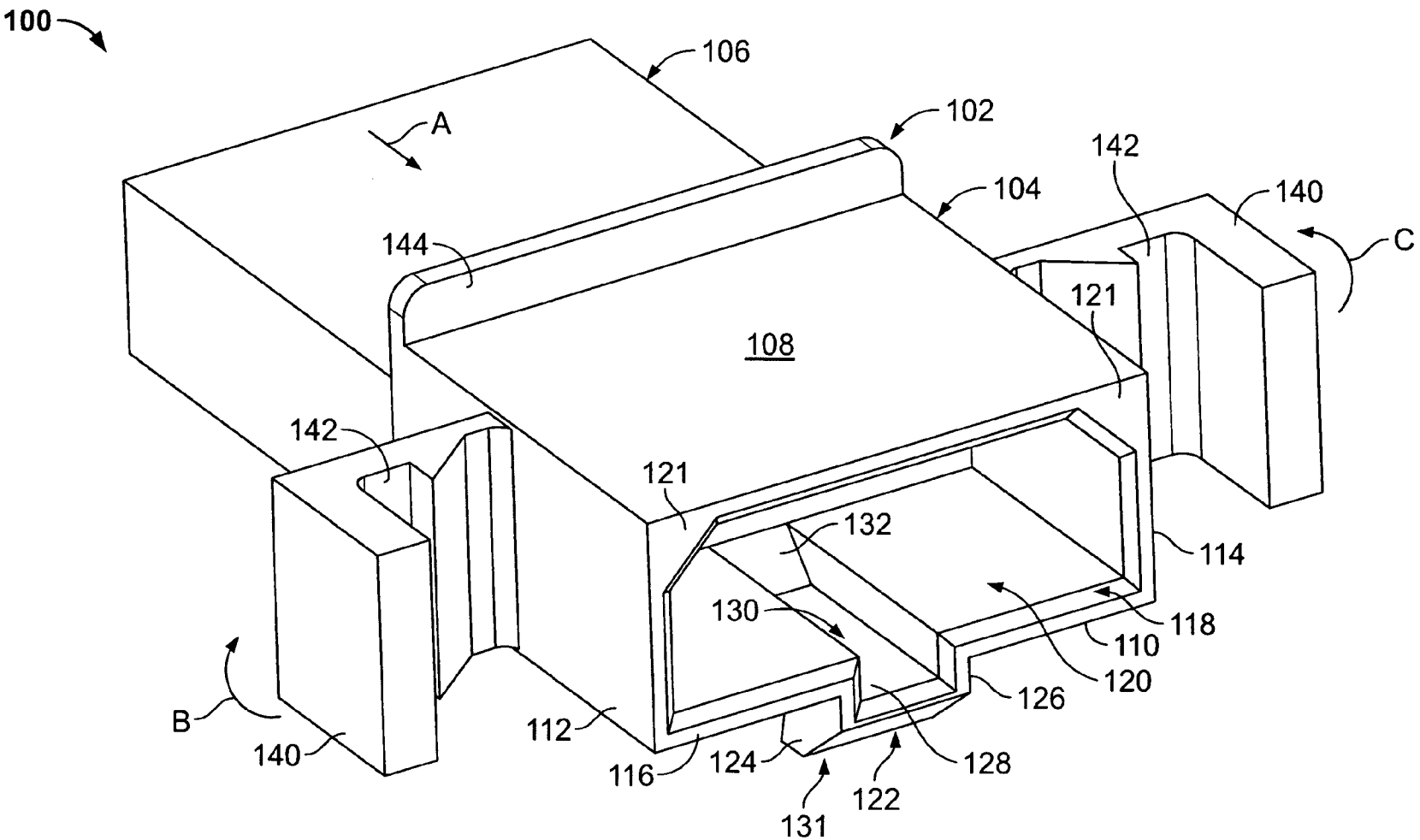
FIG. 1 is a top front perspective view of a receptacle connector formed in accordance with an exemplary embodiment of the invention.
Figure 2:
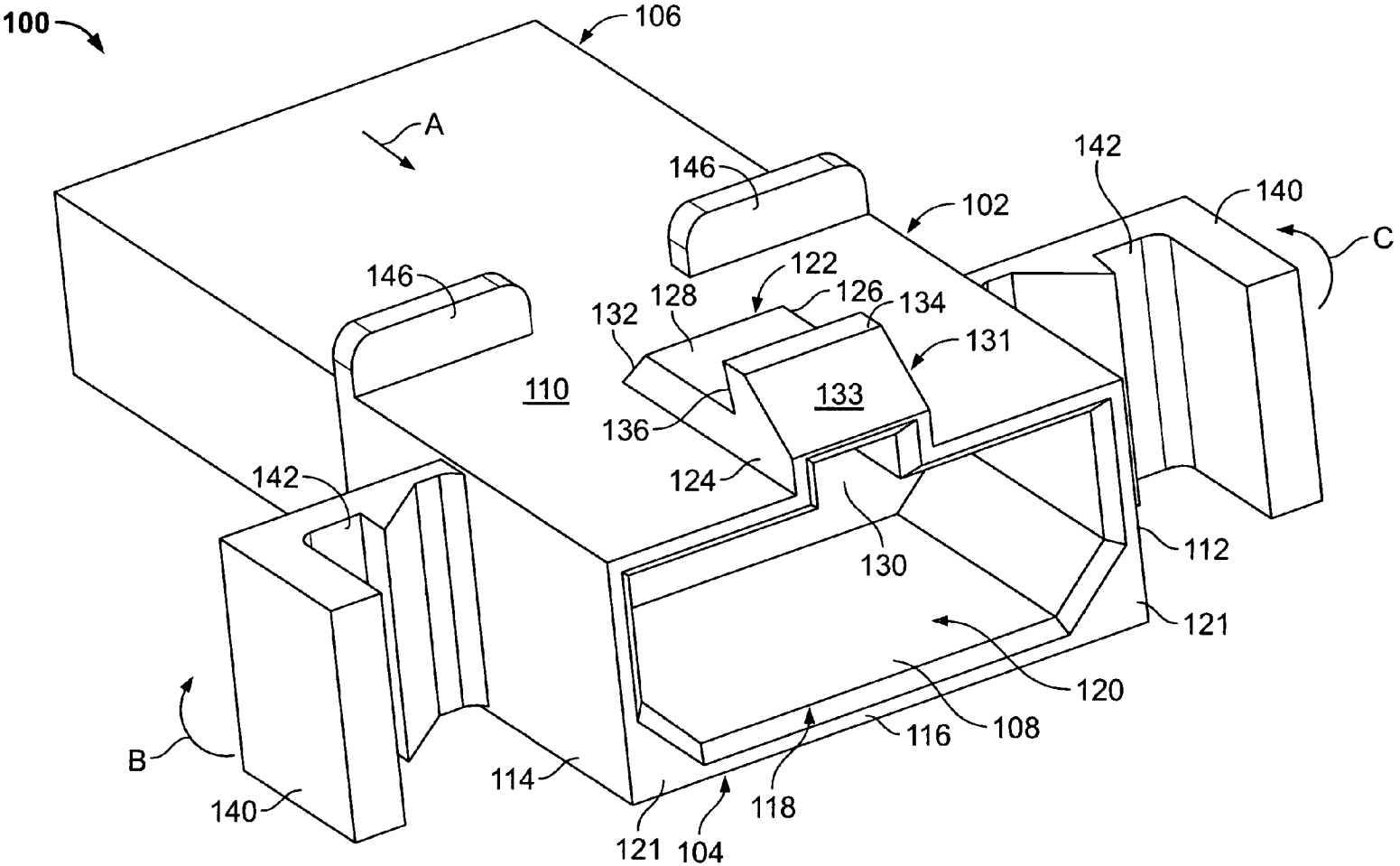
FIG. 2 is a bottom front perspective view of the receptacle connector shown in FIG. 1.

FIGS. 1 and 2 are top and bottom front perspective views of a receptacle connector 100 formed in accordance with an exemplary embodiment of the invention. The receptacle connector may be lockably mated with a plug connector (not shown in FIG. 1 but described below) and mated to a panel (not shown) while occupying a reduced amount of space on the panel. As will described below, latching and alignment features are provided in a space saving configuration which is particularly advantageous for a panel mounted connector. It is recognized, however, that the benefits of the invention also accrue to non-panel mount connectors, and the embodiments set forth and described below are provided for purposes of illustration rather than limitation. That is, the invention is not intended to be limited to any particular receptacle connector, such as the connector 100, or to any particular plug connector, such as the plug connector described below.

In an exemplary embodiment, and as shown in FIG. 1, the receptacle connector 100 includes a nonconductive housing or body 102 having a plug receiving portion 104 and a wire termination portion 106. In the illustrated embodiment, each of the plug receiving portion 104 and the wire termination portion 106 are generally rectangular in shape. The plug receiving portion 104 includes a top wall 108, a bottom wall 110, and opposite side walls 112, 114 connecting the top and bottom walls 108 and 110. Forward edges of the top, bottom and side walls 108, 110, 112, and 114 define a front face 116 and a plug insertion opening 118 providing access to a receptacle cavity 120 extending between the top, bottom and side walls 108, 110, 112, and 114. Corner guide elements 121 connect the top wall 108 and the side walls 112, and 114 and provide angled corners in the plug insertion opening 118 to assist in proper alignment of the receptacle connector 100 and the plug connector.

The bottom wall 110 of the plug receiving portion 104 includes a combined latch and keying element 122 proximate the plug insertion opening 118 which simultaneously provides alignment of the plug connector and latching to the plug connector in a single structure. As best seen in FIG. 2, the latch and keying element 122 extends outwardly from the bottom wall 110 and includes side walls 124 and 126, and a guide wall 128 extending between the side walls. The side walls 124, 126 and the guide wall 128 collectively define an alignment slot 130 having a sloped end wall 132. As seen in FIG. 1, the guide wall 128 is recessed relative to the bottom wall 110 of the plug receiving portion 104 of the connector 100 such that the alignment slot 130 is recessed relative to the receptacle cavity 120. In other words, the alignment slot 130 extends beneath the receptacle cavity 120. While the alignment slot 130 is illustrated as having a substantially rectangular or U-shaped channel configuration, other shapes and configurations of the slot 130 could be employed in other embodiments.

The guide wall 128 of the latch and keying element 122 is substantially flat when viewed from the interior of the receptacle cavity 120, but as shown in FIG. 2, the guide wall 128 includes a sloped outer contour when viewed from the exterior of the connector 100. The outer contour of the guide wall 128 forms a latch projection 131 extending outwardly and away from the plug insertion opening 118 and the alignment slot 130. Specifically, the guide wall 128 includes a sloped or beveled latch engagement surface 133 extending away from the front face 116 of the connector 100, a substantially level transition surface 134 extending rearward from the engagement surface 133, and a catch surface 136 extending substantially perpendicular to the transition surface 134. The surfaces 133, 134, and 136 of the latch projection 131 formed into an outer surface of the guide wall 128 cooperate with complementary latching features on the plug connector as described below.

The guide wall 128 and the side walls 124 and 126 of the latch and keying element 122 therefore define the alignment slot 130 on the inside of the connector, and the latch projection 131 on the outer surface of the connector. By using the guide walls 128 and the side walls 124 and 126 for dual purposes of connector alignment and latching, the connector 100 occupies a smaller space when mounted on a panel in comparison to known connectors including separate latching and alignment features. Additionally, because of the integrated latching and alignment capability of the latch and keying element 122, the connector 100 is easier to install to a panel in comparison to known connectors having separate latching and alignment features.

In an exemplary embodiment, the latch and keying element 122 is integrally formed into the connector housing 102 according to a known molding process. The guide wall 128 and the side walls 124 and 126 may be of a uniform wall thickness with the remainder of the plug receiving portion 104 of the connector 100. When the entire plug receiving portion 104 has a uniform wall thickness, relatively weaker portions of the connector housing 102 due to reduced wall thickness are avoided, and structural integrity of the connector is preserved. The connector 100 may therefore better withstand insertion forces when mated with the plug connector.

As illustrated in FIGS. 1 and 2, the latch and keying element 122 is substantially centered on the bottom wall 110 of the plug receiving portion, although it is contemplated that the latch and keying element 122 may be off-centered in alternative embodiments, and further may be located on another of the walls of the connector in lieu of the bottom wall 110. Additionally, the alignment slot 130 and the latch projection 131 in the illustrated embodiment are axially aligned with one another adjacent the front face 116 of the plug receiving portion 104. In alternative embodiments the alignment slot 130 and the latch projection may be offset from one another by varying the wall thickness of the portions of the latch and keying element 122 and by varying the outer contour of the guide wall 128 while still achieving a compact and space saving footprint of the connector 100.

In an exemplary embodiment, the plug receiving portion 104 also includes resilient panel mounting ears 140 mounted to the side walls 112 and 114. When the receptacle connector 100 is inserted through a panel cutout in the direction of arrow A, the mounting ears 140 are deflectable in the direction of arrows B and C for approximately 90° until side edges of the panel cutout are received in retaining grooves 142 formed in the ears 140. The ears 140 then resiliently maintain the receptacle connector 100 to the panel. A stop flange 144 (FIG. 1) is provided in the top wall 108 of the plug receiving portion 104 and stop flanges 146 (FIG. 2) are provided in the bottom wall 110. The stop flanges 144, 146 prevent the connector 100 from being inserted through a panel cutout beyond a predetermined amount, and effectively limit the deflection of the panel mounting ears 140 as the connector 100 is installed.

The wire termination portion 106 of the receptacle connector 100 is substantially rectangular in an exemplary embodiment, and has a slightly smaller outer dimension than the plug receiving portion 104. The wire termination portion 106 accommodates contacts (not shown) attached to wires or cables in a known manner. When the plug connector is inserted into the plug insertion opening 118, contacts in the plug connector mate with the contacts in the wire termination portion 106 in a known manner. While the receptacle connector 100 is illustrated with substantially rectangular plug receiving and wire termination portions 104, 106, it is recognized that other shapes and configurations of the connector portions 104 and 106 may be utilized in other embodiments.

Figure 3:
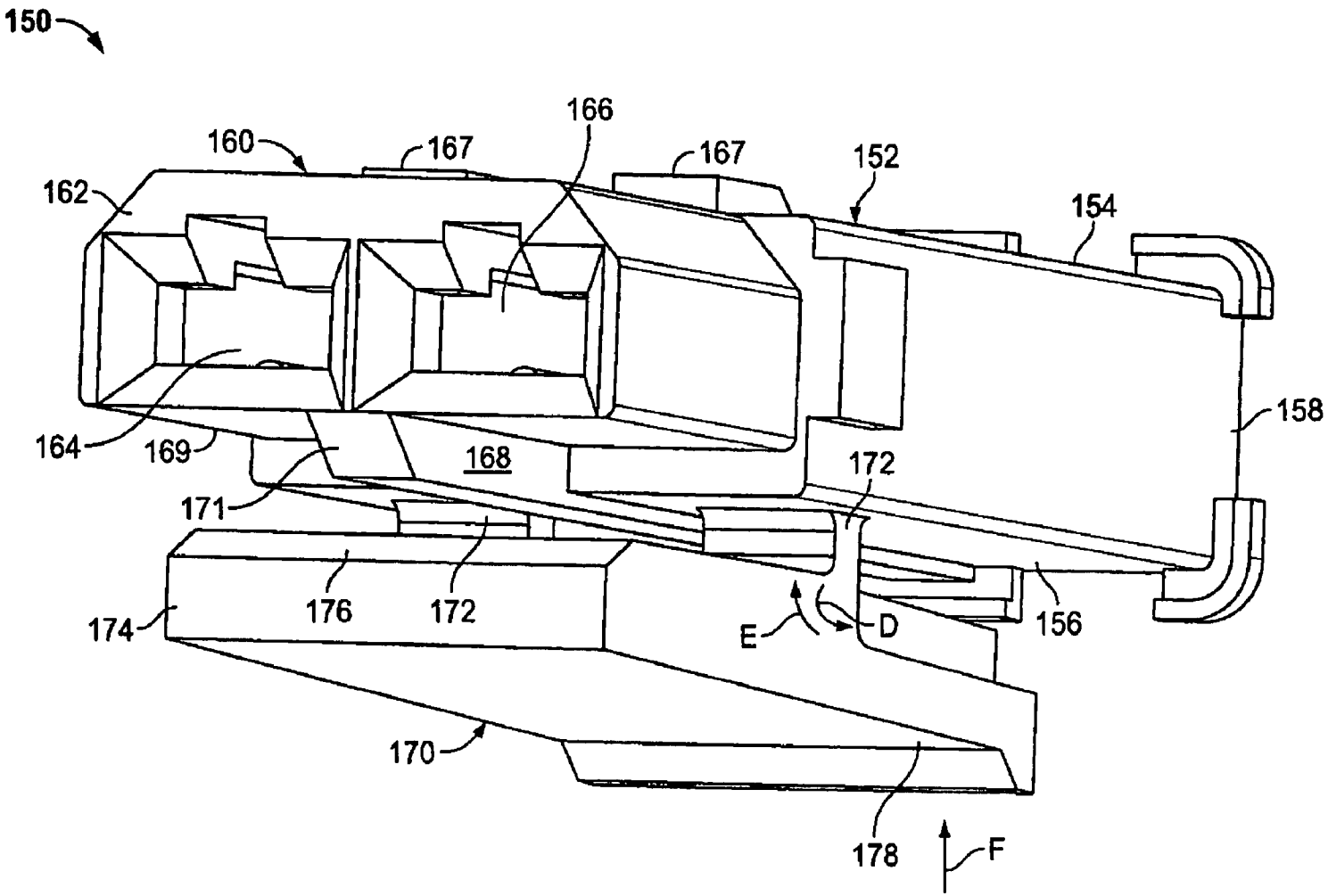
FIG. 3 is a side perspective view of an exemplary plug connector for use with the receptacle connector shown in FIGS. 1 and 2.

FIG. 3 is a side perspective view of an exemplary plug connector 150 for use with the receptacle connector 100 shown in FIGS. 1 and 2. The plug connector 150 is generally complementary in shape to the receptacle connector and includes a housing 152 having a top wall 154, a bottom wall 156, and side walls 158 connecting the top and bottom walls 154, 156. A plug portion 160 extends from the top wall 154 and includes a front face 162 dimensioned to be received in the plug insertion opening 118 (FIGS. 1 and 2) of the receptacle connector 100. Contact receptacles 164 and 166 are formed in the plug portion 160. The contact receptacles 164 and 166 include female contacts (not shown) that receive male contacts in the receptacle connector when the plug connector 150 and the receptacle connector 100 are mated to one another. In alternative embodiments, more or less contact receptacles 164, 166 may be provided to interface greater or fewer numbers of contacts in the plug and receptacle connectors 150 and 100.

An alignment key 168 extends beneath a lower surface 169 of the plug portion 160, and the key 168 includes a sloped end 171 adjacent the front face 162. The key 168 is complementary in shape to the alignment slot 130 (FIGS. 1 and 2) and is dimensioned to be received in the alignment slot 130 in the interior of the receptacle connector 100 when the plug and receptacle connectors 150 and 100 are mated to one another. Stop projections 167 are provided in the top wall 154 to prevent over-insertion of the plug portion 160 into the receptacle cavity 120 (FIGS. 1 and 2) of the receptacle connector 100. The key 168 ensures the proper polarity of the plug connector 150 relative to the receptacle connector 100.

A locking latch 170 extends beneath the plug portion 160 and the key 168 and is resiliently attached to the bottom wall 156 on mounting legs 172. The locking latch 170 is rectangular in an exemplary embodiment and includes a forward end 174 having a beveled edge 176 which engages the engagement surface 133 (FIG. 2) of the latch and keying element 122 of the receptacle connector 100 at a location exterior to the receptacle connector 100 when the plug connector 150 and the receptacle connector 100 are mated to one another. The locking latch 170 deflects and pivots about the mounting legs 172 in the direction of arrow D as the connectors are mated so that the forward edge 174 of the locking latch 170 may clear the transition surface 134 (FIG. 2) when the connectors are mated to one another. Once cleared, the locking latch 170 then pivots about the legs 172 in the direction of arrow E to lock the catch surface 136 (FIG. 2) of the receptacle connector 100 to the latch 170. Thus, the locking latch 170 resiliently deflects over the latch and keying element 122 when the plug connector 150 and the receptacle connector 100 are fully engaged and properly mated.

To un-mate the connectors 100 and 150, a user may depress a rearward end 178 of the locking latch 170 in the direction of arrow F, thereby causing the locking latch 170 to pivot about the legs 172 in the direction of arrow D to release the locking latch 170 from the catch surface 136. The plug connector 150 may then be disengaged from the receptacle connector 100 by pulling the plug connector housing in the direction of arrow G.

Figure 4:
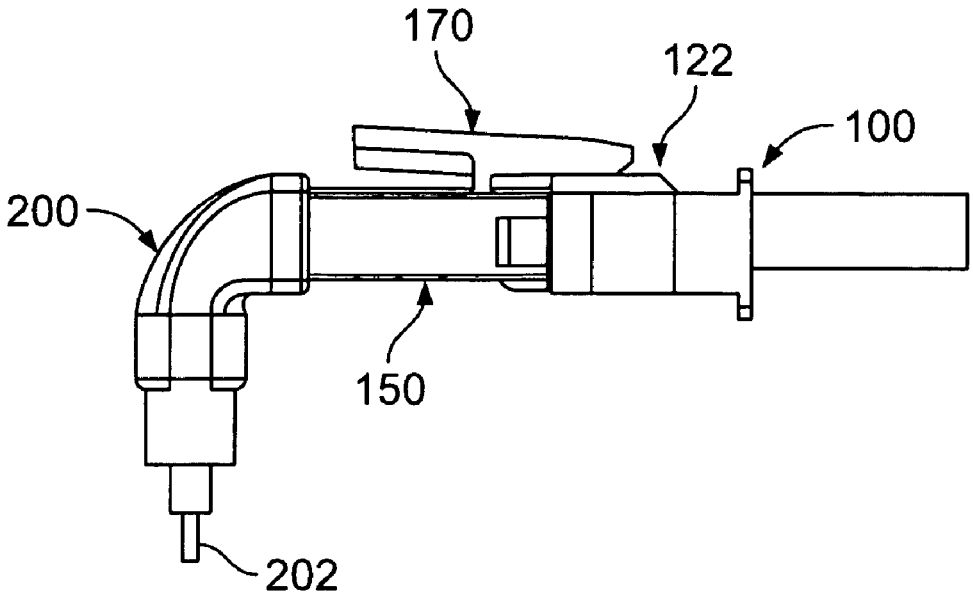
FIG. 4 is side elevational view of the plug connector mated to the receptacle connector.

FIG. 4 is a side elevational view of the plug connector 150 mated to the receptacle connector 100, and illustrating the locking latch 170 of the plug connector 150 engaged to the latch and keying element 122 of the receptacle connector 100. An overmolded wire lead assembly 200 extends from the rearward end of the plug receptacle 100 and includes an approximately 90° bend. Wire conductors 202 are encapsulated in the overmolded assembly 200 for strain relief purposes, and each of the wire conductors 202 engages corresponding contacts in the plug connector 150. In alternative embodiments, the wire conductors 202 need not include a 90° bend and may not require overmolding with the plug connector 150.

Figure 5:
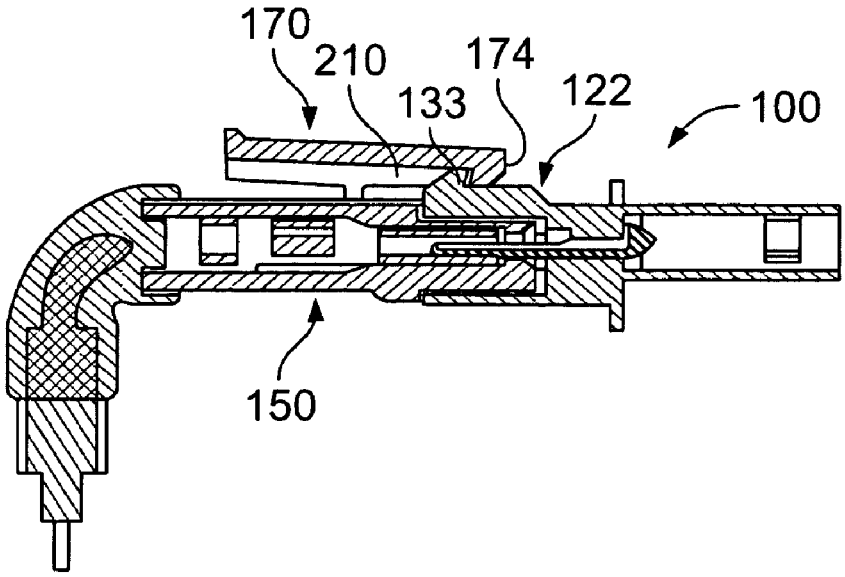
FIG. 5 is a sectional view of the mated plug and receptacle connectors shown in FIG. 4.

FIG. 5 is a sectional view of the mated plug and receptacle connectors 150, 100 in a mated condition. The locking latch 170 includes a recess or cavity 210 extending longitudinally through the locking latch 170 on either side of the latch and keying element 122 of the receptacle connector 100. The forward end 174 of the locking latch 170 has moved past the engagement surface 133 of the latch and keying element 122 of the receptacle connector 100, and the locking latch 170 has deflected over the engagement surface 133 and the transition surface 134 (FIG. 2). The forward end 174 of the locking latch 170 has pivoted toward the latch and keying element 122 to lock the catch surface 136 (FIG. 2) of the latch and keying element within the cavity 210 of the locking latch 170. The latch and keying element 122 and the locking latch 170 therefore cooperatively lock to one another to prevent separation of the connectors 100, 150 from one another.

While the invention has been described in terms of various specific embodiments, those skilled in the art will recognize that the invention can be practiced with modification within the spirit and scope of the claims.

What is claimed is:

1. A receptacle connector comprising:

a nonconductive housing comprising housing walls that surround a plug insertion opening extending into said housing, a first of said housing walls including a latch and keying element formed thereon, said latch and keying element having an exterior surface forming a latch projection that extends outside of said plug insertion opening, said latch and keying element being formed with latch walls extending outwardly from said first housing wall, said latch walls having inner surfaces that form an alignment slot that extends along said plug insertion opening, wherein a second wall of said housing walls that extends opposite to said first housing wall does not include a slot therein.

2. A receptacle connector in accordance with claim 1 wherein said latch projection and said alignment slot are axially aligned with one another.

3. A receptacle connector in accordance with claim 1 wherein said alignment slot is approximately centered with respect to said plug insertion opening.

4. A receptacle connector in accordance with claim 1 wherein said latch projection includes a beveled end adjacent said plug insertion opening.

5. A receptacle connector in accordance with claim 1 wherein said alignment slot is substantially rectangular.

6. A receptacle connector in accordance with claim 1 further comprising panel mounting ears attached to said housing.

7. A receptacle connector in accordance with claim 1 wherein said housing defines a receptacle cavity, said alignment slot recessed relative to said cavity.

8. A receptacle connector in accordance with claim 1 wherein said latch projection is integrally formed into said housing.

9. A connector assembly comprising:

a receptacle connector comprising a nonconductive housing comprising housing walls that surround a plug insertion opening, said receptacle connector further comprising an integrated latch and key element having latch walls that extend outward from a first of said housing walls, said latch walls having uniform wall thickness, said integrated latch and key element comprising a recessed slot extending adjacent said opening along an inner surface of said latch walls and a latch projection extending outwardly from an outer surface of said latch walls; and a plug connector having a polarizing key and a locking latch element, said polarizing key being inserted into said recessed slot of said latch and key element when said plug connector is mated to said receptacle connector, said locking latch element being engaged to said latch projection when said plug connector is mated to said receptacle connector, wherein said recessed slot of said latch and key element does not receive an electrical contact of said plug connector therein when said plug connector is mated to said receptacle connector.

10. A receptacle connector in accordance with claim 9 wherein said slot is approximately centered with respect to said plug insertion opening.

11. A receptacle connector in accordance with claim 9 wherein said slot defines a portion of said latch projection.

12. A receptacle connector in accordance with claim 9 wherein said slot is substantially rectangular.

13. A receptacle connector in accordance with claim 9 wherein said housing further comprises panel mounting ears.

14. A receptacle connector in accordance with claim 9 wherein said latch walls comprise side walls extending from said housing wall and a recessed guide wall proximate said plug insertion opening extending between said side walls.

15. A receptacle connector in accordance with claim 9 wherein said integrated latch and key element is integrally formed into said one of said housing walls.

16. A connector assembly comprising:

a receptacle connector comprising a housing having a housing wall that partially surrounds a plug insertion opening and comprising a combined latch and keying element extending from said housing wall proximate said plug insertion opening, said latch and keying element having an interior surface forming said keying element along said plug insertion opening, said latch and keying element having an exterior surface forming said latch element outside of said plug insertion opening; and a plug connector comprising a housing having a polarizing key and a locking latch element, said polarizing key being inserted into said plug insertion opening and received within said keying element when said plug connector is mated to said receptacle connector, and said locking latch element engaged to said latch element at a location exterior to said plug insertion opening when said plug connector is mated to said receptacle connector, wherein said keying element does not receive an electrical contact of said plug connector therein.

17. A connector assembly in accordance with claim 16 wherein said locking latch element is pivotally mounted to said plug connector, said locking latch element resiliently deflecting over said latch and keying element when said plug connector and said receptacle connector are engaged.

18. A connector assembly in accordance with claim 16 wherein at least one of said plug connector and receptacle connector further includes panel mounting ears.

19. A connector assembly in accordance with claim 16 wherein said combined latch and keying element is integrally formed into said housing of said receptacle connector.

20. A connector assembly in accordance with claim 16 wherein said combined latch and keying element is substantially centered on a side of said receptacle connector.

* * * * *